US005432593A

United States Patent [19]

Nishikawa et al.

[11] Patent Number: 5,432,593

[45] Date of Patent: Jul. 11, 1995

[54] SHEET OVERHEAT PREVENTION MECHANISM FOR FIXING DEVICE

[75] Inventors: Tomoyuki Nishikawa; Yoshimi Saito, both of Tokyo, Japan

[73] Assignee: Asahi Kogaku Kogyo Kabushiki Kaisha, Tokyo, Japan

[21] Appl. No.: 175,104

[22] Filed: Dec. 29, 1993

[30] Foreign Application Priority Data

Dec. 29, 1992 [JP] Japan ..... 4-093810 U

[51] Int. Cl.[6] ..... G03G 15/20

[52] U.S. Cl. ..... 355/290; 355/282; 355/285; 355/295

[58] Field of Search ..... 355/285, 289, 290, 295, 355/282, 308, 309, 316, 321, 317; 219/216; 226/49, 143; 430/124, 126, 98, 99

[56] References Cited

U.S. PATENT DOCUMENTS

| | | | |
|---|---|---|---|
| 4,162,847 | 7/1979 | Brandon | 355/285 |
| 4,595,279 | 6/1986 | Kuru et al. | 355/282 |
| 4,890,140 | 12/1989 | Negoro et al. | 355/290 |
| 4,924,266 | 5/1990 | Negoro et al. | 355/308 X |
| 4,949,104 | 8/1990 | Negoro et al. | 355/316 X |
| 4,963,941 | 10/1990 | Negishi et al. | 355/282 |
| 5,019,872 | 5/1991 | Zajec, Jr. | 355/282 X |
| 5,023,667 | 6/1991 | Negoro et al. . | |
| 5,063,416 | 11/1991 | Honda et al. . | |
| 5,087,947 | 2/1992 | Torino | 355/290 |
| 5,109,255 | 4/1992 | Nishikawa et al. . | |
| 5,170,215 | 12/1992 | Pfeuffer | 355/285 |
| 5,185,627 | 2/1993 | Hartman | 355/208 X |
| 5,187,528 | 2/1993 | Nishikawa et al. | 355/290 |
| 5,189,470 | 2/1993 | Matsuda et al. | 355/208 |
| 5,194,903 | 3/1993 | Negishi et al. . | |
| 5,210,583 | 5/1993 | Monma et al. | 355/309 |
| 5,253,013 | 10/1993 | Takano et al. . | |
| 5,305,068 | 4/1994 | Sato et al. | 355/309 |

*Primary Examiner*—Matthew S. Smith

*Attorney, Agent, or Firm*—Sandler, Greenblum & Bernstein

[57] ABSTRACT

An electrophotographic imaging apparatus for forming an image on a continuous recording sheet, transfers a toner image to the continuous recording sheet using a transfer unit. A tractor feeds the recording sheet from the transfer unit to a fixing unit where heat and pressure are applied to the recording sheet to fuse the toner image. A controller controls the fixing unit so that heat and pressure are applied to the continuous recording sheet after the tractor starts feeding the continuous recording sheet, and controls the fixing unit to inhibit the application of heat and pressure to the continuous recording sheet before the tractor stops feeding the recording sheet.

11 Claims, 14 Drawing Sheets

SHEET OVERHEAT PREVENTION MECHANISM FOR FIXING DEVICE

FIELD OF THE INVENTION

The present invention relates to a fixing device of an electrophotographic imaging device.

BACKGROUND OF THE INVENTION

Conventionally, imaging devices employing an electrophotographic imaging process are known. One type of imaging device is a printer which can print an image on a continuous sheet, such as a fan-fold sheet. The fan-fold sheet is provided with feed holes at its sides, and perforations which define segments (pages) of the sheet. The fan-fold sheet has conventionally been used in a line printer.

In the electrophotographic printer using a continuous sheet, if the sheet is nipped between a heat roller and press roller in a fixing device, and the sheet is not being fed, the portion of the sheet nipped between the heat roller and the press roller will be overheated. Thus, the nipped portion of the sheet may be discolored or scorched. In order to avoid this problem, the electrophotographic printer has been so constructed that the heat roller and the press roller are detached from each other so that the sheet is not nipped therebetween after the printing operation is finished.

If the printer is constructed as above, however, when the printing is restarted, the heat roller and the press roller which are separated from each other will contact the sheet nipped therebetween. If the heat roller and the press roller nip the continuous sheet, the portion of the sheet which contacts the heat roller is overheated as mentioned above. Further, if the sheet has an unfixed toner image the image may be smudged or become uneven since the portion of the press roller, which contacts the heat roller has a higher temperature than the other portion of the press roller.

SUMMARY OF THE INVENTION

It is therefore an object of the present invention to provide an improved fixing device which separates the heat roller and the press roller when the sheet is not fed, and capable of preventing the overheating when the feeding of the sheet is restarted.

For the above object, according to one aspect of the present invention, there is provided an electrophotographic imaging apparatus for executing an imaging operation to form an image on a continuous recording sheet. The apparatus includes:

a transferring device for transferring a toner image onto the recording sheet;

a fixing device for fixing an unfixed toner image transferred by the transferring device, with the fixing device including a pair of rollers, with at least one roller of the pair of rollers being movable with respect to the other roller so as to be located at an operating position wherein the continuous recording sheet is nipped between the pair of rollers, or at a retracted position where the pair of rollers are apart from each other.

The apparatus further includes a feeding device for forwardly feeding the continuous sheet when the imaging operation is executed; and a moving device for locating at least one roller located at the retracted position to the operating position after the feeding device starts feeding the continuous sheet, and for rotating at least one roller before the one roller reaches the operating position.

Optionally, the moving means moves at least one roller to the operating position when the unfixed toner image reaches the fixing device. Alternatively, the moving device moves at least one roller to the operating position when the transferring device starts transferring the toner image.

According to another aspect of the invention, there is provided an electrophotographic imaging apparatus for forming an image on a continuous recording sheet. The apparatus includes:

a transferring device for transferring a toner image onto the recording sheet;

a fixing device for applying predetermined heat and pressure to the toner image to fix the toner image onto the continuous recording sheet;

a feeding device for feeding the continuous sheet when the toner image is formed on the continuous sheet; and a controlling device for controlling the fixing device to apply the predetermined heat and pressure after the feeding device starts feeding the recording sheet and to inhibit application of the heat and pressure before the feeding device stops feeding the recording sheet.

DESCRIPTION OF THE ACCOMPANYING DRAWINGS

DESCRIPTION OF THE EMBODIMENTS

Figure 1:
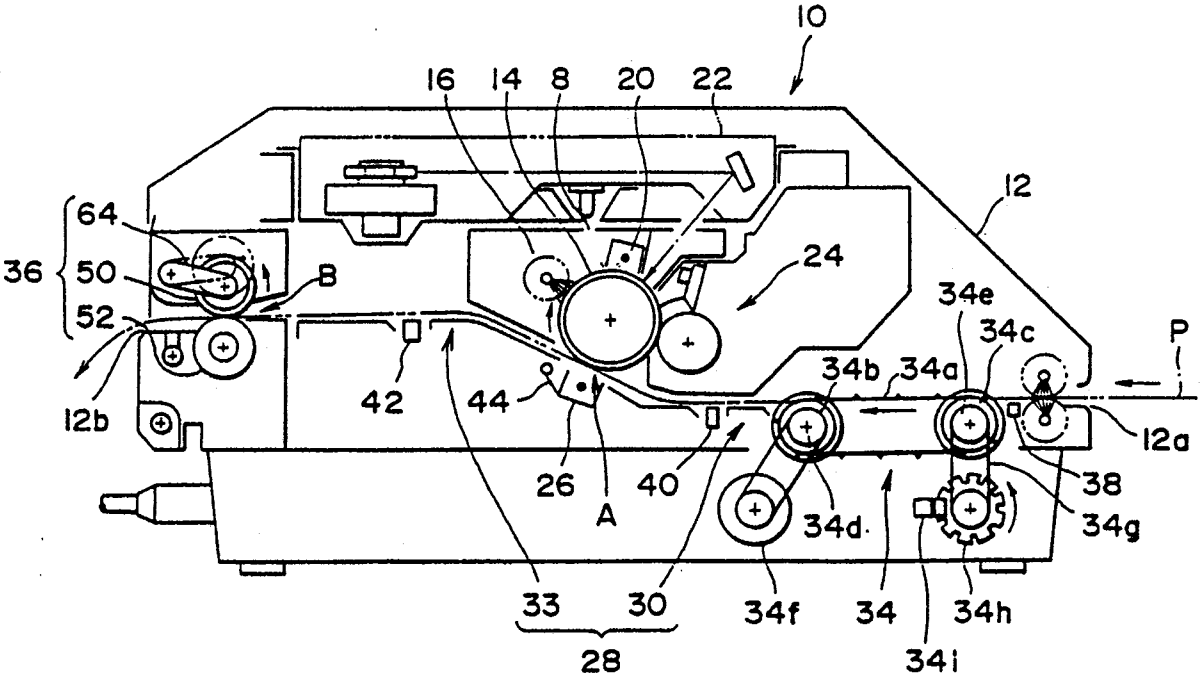
FIG. 1 is a schematic side view of an electrophotographic printer embodying the present invention.

FIG. 1 shows a schematic side view of a laser beam printer 10 embodying the present invention. The laser beam printer 10 prints an image onto a fan-fold sheet (continuous sheet) P with use of an electrophotographic imaging process in accordance with image data inputted from an external source such as a computer.

The laser beam printer 10 has a printer body 12 which accommodates a photoconductive drum 14. The photoconductive drum 14 can be rotated by a motor (not shown) at a predetermined velocity. The following are provided around the photoconductive drum 14:

a toner cleaning unit 16 for removing residual toner from the circumferential surface of the photoconductive drum 14;

a discharging unit 8 for discharging the photoconductive surface of the drum 14;

a charging unit 20 for uniformly charging the circumferential surface of the photoconductive drum 14;

a laser scanning unit 22 for emitting a scanning laser beam carrying image information onto the uniformly charged surface of the photoconductive drum 14 in order to form a latent image;

a developing unit 24 for developing the latent image formed on the photoconductive drum 14 into a toner image; and a transfer unit 26 for transferring the toner image onto a recording medium, i.e., a fan-fold sheet P.

A transfer position, A, is defined by the photoconductive drum 14 and the transferring unit 26 arranged below the photoconductive drum 14. A sheet feed path 28 (30, 33), along which the fan-fold sheet P is fed, extends in the right and left directions from the position A. At an upstream portion 30 of the sheet feed path 28, a tractor unit 34 is provided. The tractor unit 34 serves as a feeding means, and feeds the fan-fold sheet P, introduced into the printer body 12 through inlet 12*c* and discharged out through outlet 12*b*. At the downstream portion of the sheet feed path 30, a fixing unit 36 is provided. The fixing unit 36 fuses the transferred toner image onto the fan-fold sheet P.

Photosensors 38, 40, and 42 are provided upstream of the tractor unit 34, between the tractor unit 34 and the photoconductive drum 14, and between the photoconductive drum 14 and the fixing unit 36, respectively, in order to detect the presence of the fan-fold sheet P.

In the laser beam printer 10, the photoconductive surface of the photoconductive drum 14 is scanned by a laser beam emitted by the laser scanning unit 22. The laser beam scans along the axial direction of the photoconductive drum 14. The photoconductive drum 14 is driven to rotate about its axis while being scanned by the laser beam in the axial direction. Thus, the photoconductive surface of the photoconductive drum 14 is scanned to form a latent image. Toner is applied to the latent image by the developing unit 24 to form a toner image. The transfer unit 26 transfers the toner image onto the fan-fold sheet P, which is fed by the tractor unit 34 along the sheet feed path 28. The toner image transferred to the fan-fold sheet P is fixed by the fixing unit 36, and then discharged out of the printer body 12.

The tractor unit 34 has a pair of tractor belts 34*a*. Each of the tractor belts 34*a* is an endless belt wound around a pair of feed rollers 34*b* and 34*c*. On each belt 34*a*, a plurality of protrusions to be engaged with feed holes, formed on each side of the fan-fold sheet P, are provided (in this embodiment, the feed holes, i.e., the protrusions, are formed at ½ inch intervals). The feed rollers 34*b* and 34*c* are secured to shafts 34*d* and 34*e*, which are arranged parallel to each other. One of the rollers 34*b* is connected with a motor 34*f* which can be rotated in both the forward and reverse directions. In accordance with the rotation of the motor 34*f*, the fan-fold sheet P is fed forward (in the direction from the inlet to the outlet) or backward (in the direction from the outlet to the inlet).

An encoder 34*h* is connected with the roller 34 by means of another endless belt 34*g* which is wound around the roller 34*c*. On the peripheral end of the encoder 34*h*, a plurality of slits which correspond to the protrusions provided on the belt 34*a* are formed. A photo-interrupter 34*i*, having a light emitting device and light receiving device, is provided to detect the slits as the paper is fed. By detecting the number of slits passing within a predetermined time period, the feeding speed of the fan-fold sheet P can be known.

The transfer unit 26 has a transfer charger extending in the axial direction of the photoconductive drum 14 and having substantially the same length as the longitudinal length of the photoconductive drum 14. The transfer charger is supported by an arm member 44, and arranged parallel with the axis of the photoconductive drum 14 at a position separated from the circumferential surface of the photoconductive drum 14 by a predetermined distance. The transfer charger can be retracted from its operable position, as shown in the figure, by rocking the arm member 44.

The distance of the sheet feed path between the position A and a fixing position B is less than the smallest page length (the length between two subsequent perforations of the fan-fold sheet) of the fan-fold sheets P, which can be used in the laser beam printer of the embodiment.

Figure 2:
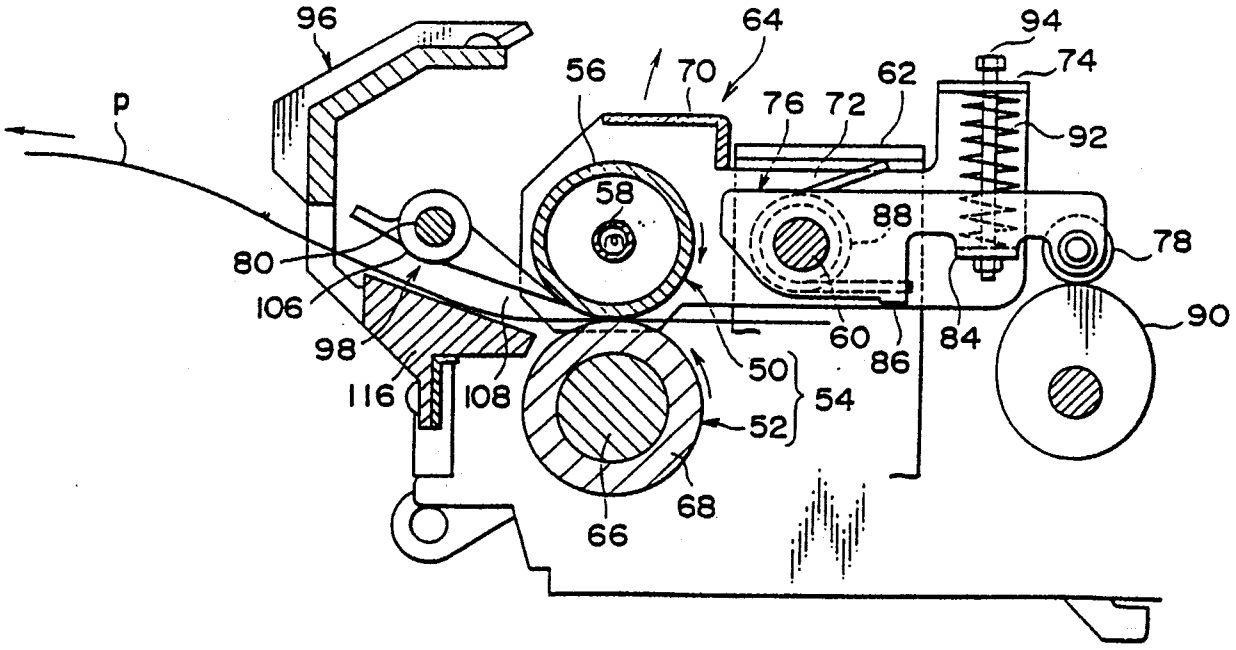
FIG. 2 is a schematic enlarged side view of the fixing device.

The fixing unit 36 has, as shown in FIG. 2, a pair of heat rollers including a heat roller 50 and a press roller 52 which is arranged below the heat roller 50. The heat roller 50 and the press roller 52 are arranged so that their axes are orthogonal to the feeding direction of the fan-fold sheet P. The toner image transferred on the fan-fold sheet P is fixed by the pair of rollers 54.

The heat roller 50 has a hollow cylindrical body 56, and a halogen lamp 58 accommodated in the body 56. As the halogen lamp 58 generates heat, the temperature of the outer circumferential surface of the body 56 of the heat roller 50 is raised to a predetermined temperature. Axial ends of the heat roller 50 are rotatably supported by a holder 64 mounted on a chassis 62. On one end of the heat roller 50, a gear member (not shown) is provided, which receives the rotational force from a main motor (not shown) through a gear train (not shown).

The press roller 52 has a metal core 66, and a layer 68 of an elastic material, such as silicon rubber, having heat-resistance and a predetermined hardness. The press roller 52 is rotatably supported on a predetermined portion of the chassis 62.

The holder 64 supporting the heat roller 50 has substantially the same length as that of the heat roller 50 along the axial direction thereof. The holder 64 is provided with a connecting plate 70 above the heat roller 50, and a pair of arm members 72 extending towards the upstream end of the sheet feed path 28 at the end portions of the connecting plate 70. The arm members 72 are mounted on the chassis 62 such that they partially rotate about the axis 60. At the top of each arm member 72, a spring receiving portion 74 is formed by bending a top portion thereof toward the other arm member 72. A pair of levers 76 are supported such that they can be partially rotated about shaft 60. The pair of levers 76 are arranged to be on the inner side of the arm members 72 respectively. At the non-supported ends of each lever 76, a cam follower 78 is rotatably mounted. At the lower end of the each lever 76, opposite to the spring receiving portion 74, a spring holding protrusion 84 is formed on the lever 76. Adjacent to the spring holding protrusion 84, a hook 86 is formed to protrude outwards.

Figure 4:
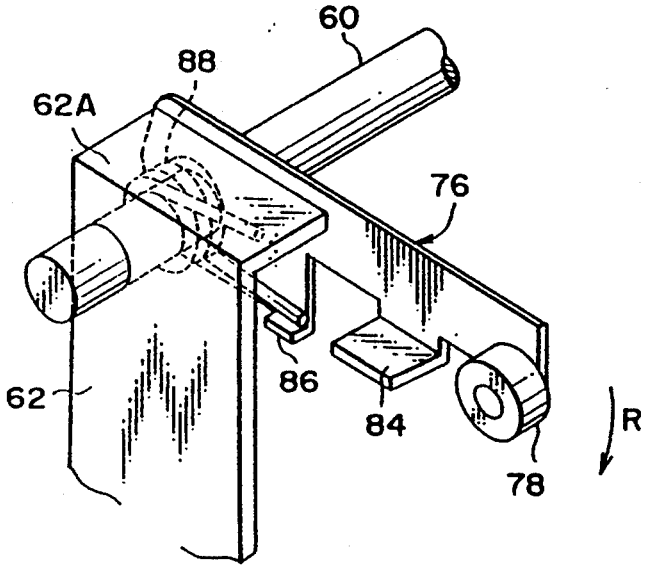
FIG. 4 is a perspective view of a lever mechanism.

As shown in FIG. 4, a torsion spring 88 is inserted between each lever 76 and arm member 72. One end of each torsion spring 88 is received by the hook 86, and the other end contacts a hook portion 62A which is formed by bending the upper end of the chassis 62 inward. Due to the resilient force of each torsion spring 88, the lever 76 is biased to rotate in the clockwise direction about the shaft 60, as indicated by arrow R in FIG. 4. Thus, the cam follower 78 mounted on each lever 76 forcibly contacts the cam surface of an eccentric cam 90.

Figure 3:
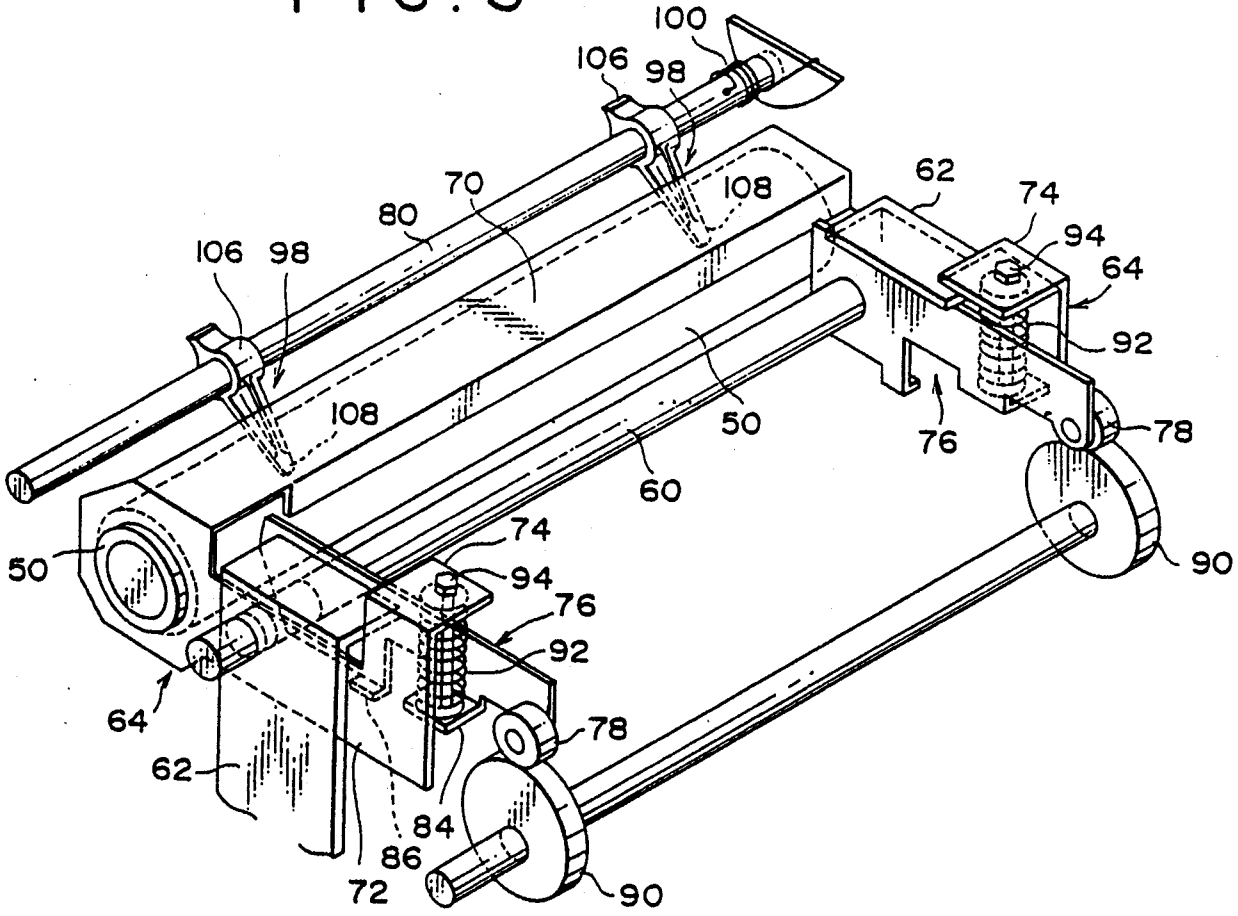
FIG. 3 is a perspective view of the retraction mechanism of the heat roller.

As shown in FIGS. 2 and 3, a coil spring 92 is inserted between each spring receiving portion 74 and corresponding spring holding portion 84. As a result of the resilient force of each coil spring 92, the portion 74 is forced away from the spring holding protrusion 84, and thus, the holder 64 is rotated in the counterclockwise direction about the shaft 60 in FIG. 3. A bolt 94 is provided between each spring receiving portion 74 and spring holding protrusion 84. One end of the bolt 94 is secured to the spring holding protrusion 84. The other end of the bolt 94 is inserted through the corresponding spring receiving portion 74. Since the head of the bolt 94 is formed not to pass through the hole through which the bolt 94 is inserted, the angle by which the holder 64 can be rotated is limited so that it does not exceed a predetermined amount.

As described above and shown in FIGS. 2 and 3, when the eccentric cam 90 is in the position shown in the drawings (i.e., long side up), the cam follower 78 is at its highest vertical position. This forces levers 76 upwards, thus forcing spring receiving portion 74 upwards. This results in arm member 72 rotating counter clockwise about shaft 60, and heat roller 50 being brought into contact with press roller 52. When the eccentric cam 90 has its short side up, the cam follower 78 is biased downwards by spring 92, and thus, spring receiving portion 74 is also lowered. This results in lever 72 being rotated clockwise about shaft 60, and thus, heat roller 50 is raised out of contact with press roller 52.

The eccentric cam 90 is rotated by a control unit (not shown) such that the heat roller 50 is biased towards the press roller 52 (i.e., located at an operating position) when the fixing operation is performed, and is retracted when in the standby state (i.e., the fixing operation is not performed).

Figure 5:
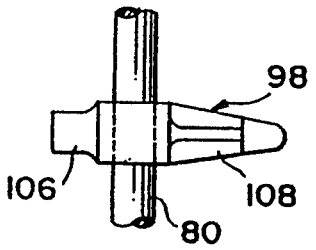
FIG. 5 is a plan view of a jam prevention pawl.

On the body 12 of the laser beam printer 10, a discharge cover 96, which can be opened, is provided as shown in FIG. 2. The discharge cover 96 is opened by rocking the upper end of the cover 96 in the counterclockwise direction (in FIG. 2) about the lower end thereof. A shaft 80 is supported by the discharge cover 96, the axis of the shaft 80 being parallel with the axis of the heat roller 50. On the shaft 80, a pair of jam prevention pawls 98 are provided as shown in FIG. 3. On one end of the shaft 80, a spring 100 is wound so that the shaft is forced to rotate in the counterclockwise direction in FIG. 3. The tips of these jam prevention pawls 98 always contact the circumferential surface of the heat roller 50. Thus, even if the fan-fold sheet P passes through the nip of the pair of fixing rollers 54 and is stuck to the outer surface of the heat roller 50, the sheet P is removed from the heat roller 50 by the jam prevention pawls 98, and thus, a jam is prevented. Each jam prevention pawl 98 has a cylindrical base portion 106 through which the shaft 80 is inserted and secured thereto, and a protruding portion 108 as shown in FIG. 5.

Below the shaft 80 (i.e., on the downstream side with respect to the press roller 52), a lower sheet discharge guide 116 is provided. The fan-fold sheet P, that has passed through the nip between the pair of fixing rollers 54, is removed from the circumferential surface of the heat roller 50 by the jam prevention pawls 98, and fed along the sheet discharge guide 116 towards the outlet **12*b***.

Figure 6:
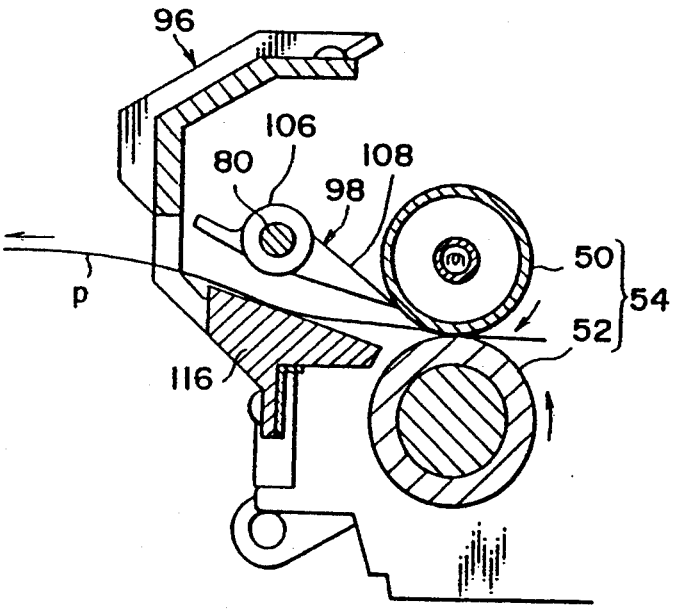
FIG. 6 is a schematic sectional side view of the fixing device showing the operation of the jam prevention pawl when fixing is executed.
Figure 7:
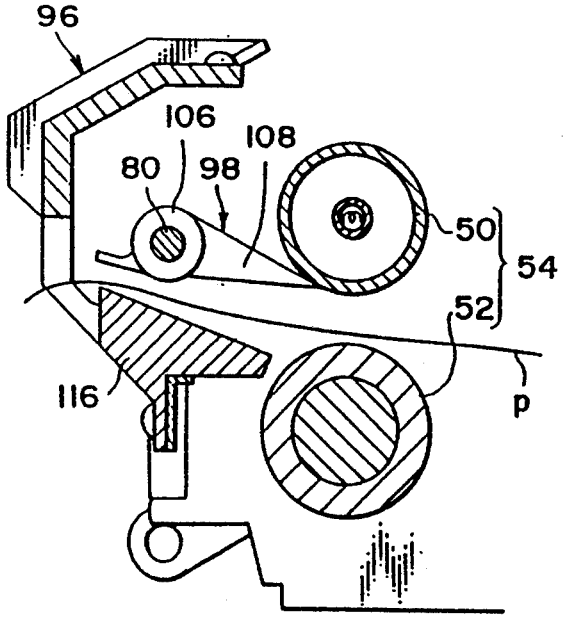
FIG. 7 is a schematic sectional side view of the fixing device showing the operation of the jam prevention pawl when the heat roller is retracted.

When the heat roller 50 is located at the operating position, the jam prevention pawls 98 are urged against the heat roller 50 by the spring 100 as shown in FIG. 6. If the fan-fold sheet P is adhered to the heat roller 50 because of the fused toner, the sheet P is removed from the heat roller 50 by the jam prevention pawls 98, and discharged without jamming.

In the standby state, the heat roller 50 is retracted away from the press roller 52. When the heat roller 50 is retracted, the shaft 80 rotates in the counterclockwise direction due to the resilient force of the spring 100. According to the rotary movement of the shaft 80, the jam prevention pawls 98 also rotate in the counterclockwise direction. Thus, the jam prevention pawls 98 keep contacting the heat roller 50. Therefore the jam prevention pawls 98 prevent the sheet P from adhering to the heat roller 50 when the heat roller 50 is retracted.

When a new fan-fold sheet P is loaded in the laser beam printer, it is preferable that the heat roller 50 is located at the operating position before the leading edge of the fan-fold sheet P reaches the pair of fixing rollers 54. This will enable uniform heating of the sheet P as it passes through the nip between the heat roller 50 and the press roller 52, and will result in a smooth fixing operation and good image production.

Hereinafter, the operation of the fixing device, according to the present invention, will be described.

Figure 8:
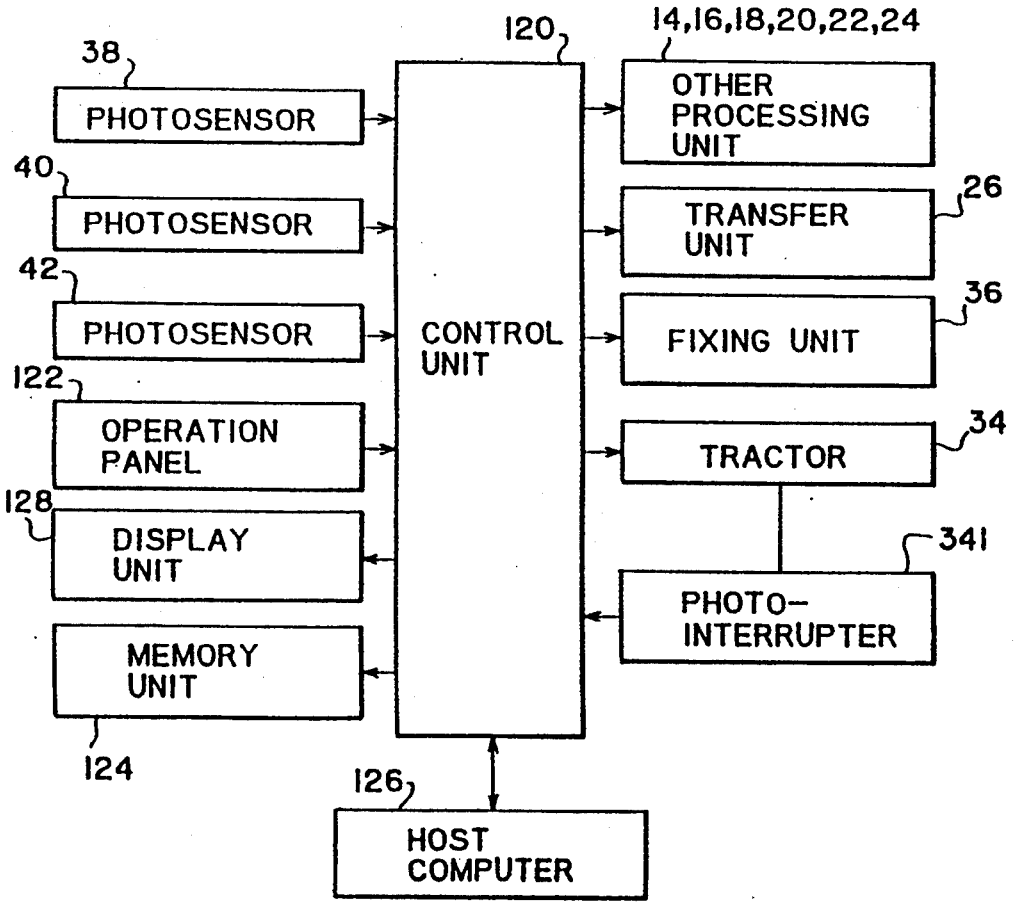
FIG. 8 is a block diagram showing the control system of the electrophotographic printer.

FIG. 8 is a block diagram of the laser beam printer 10 according to the present invention.

A control unit 120 controls the following:

a feeding operation of the tractor unit 34 which is driven by a motor **34*f***;

a transferring operation by the transfer unit 26;

a retraction movement of the transfer charger of the transfer unit 26;

a fixing operation by the fixing unit 36 and the retraction movement of the heat roller 50; and operations of respective units (i.e., the photoconductive drum 14, toner cleaning unit 16, discharging unit 18, charging unit 20, laser scanning unit 22, and developing unit) in order to form an image.

Information related to the sheet feeding is transmitted from a photo-interrupter 341, photosensors 38, 40, and 42, to the control unit 120. Further, information related to the operation of an operation panel 122 is also transmitted. The control unit 120 also has a memory unit 124 including a writeable ROM (read only memory). The memory unit 124 stores data representing paper sizes, communication protocol, the number of pages to be printed and other information.

The control unit 120 controls the laser beam printer 10 to form an image based on image data stored in a page memory (not shown) which is transmitted from a host computer 126. A display unit 128 is a unit for displaying the information related to an error condition, the display unit 128 having a display such as an LCD (11quid crystal display).

Figure 9A:
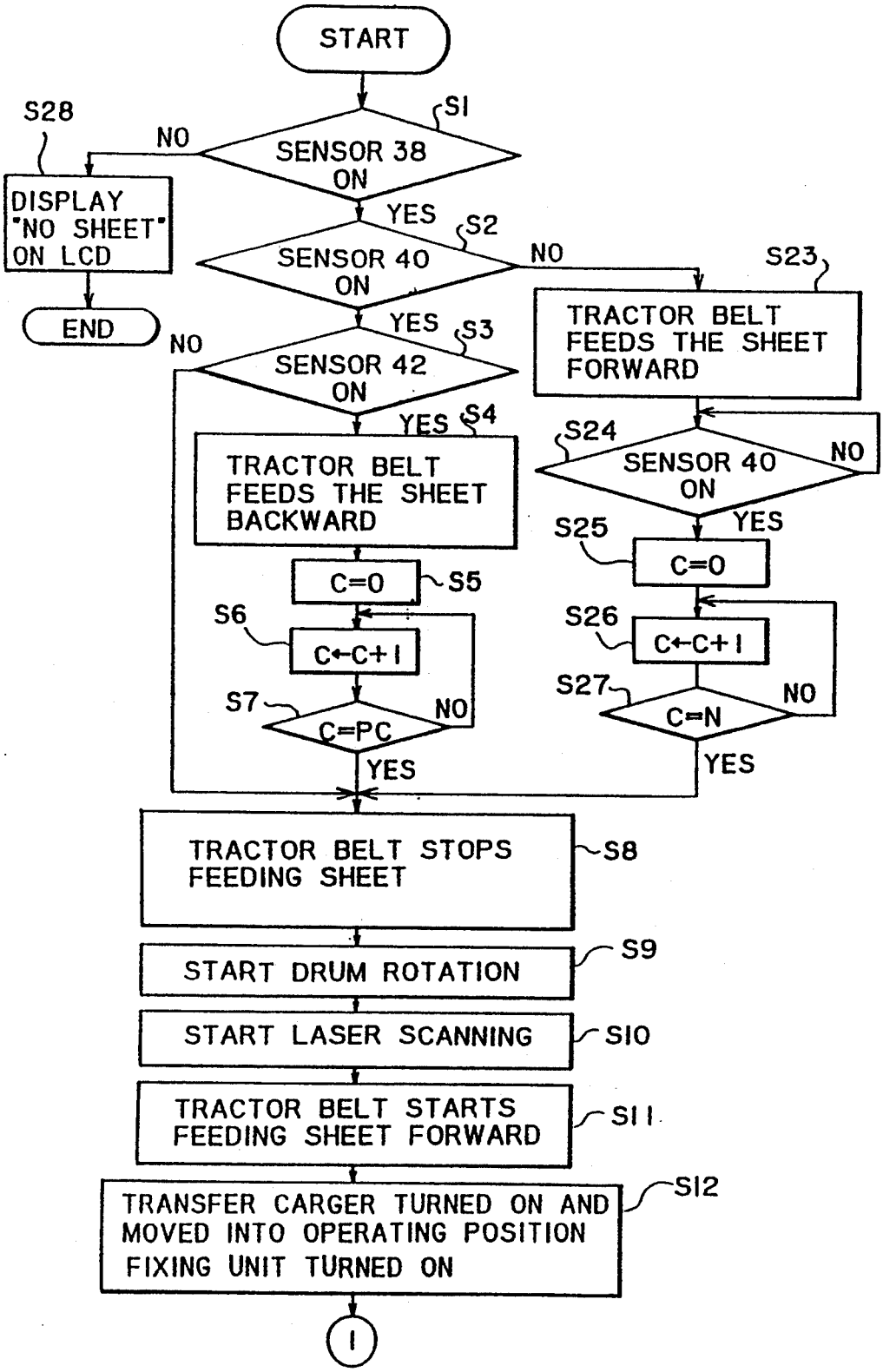
FIGS. 9A and 9B are flowcharts illustrating the imaging operation of the electrophotographic printer.
Figure 9B:
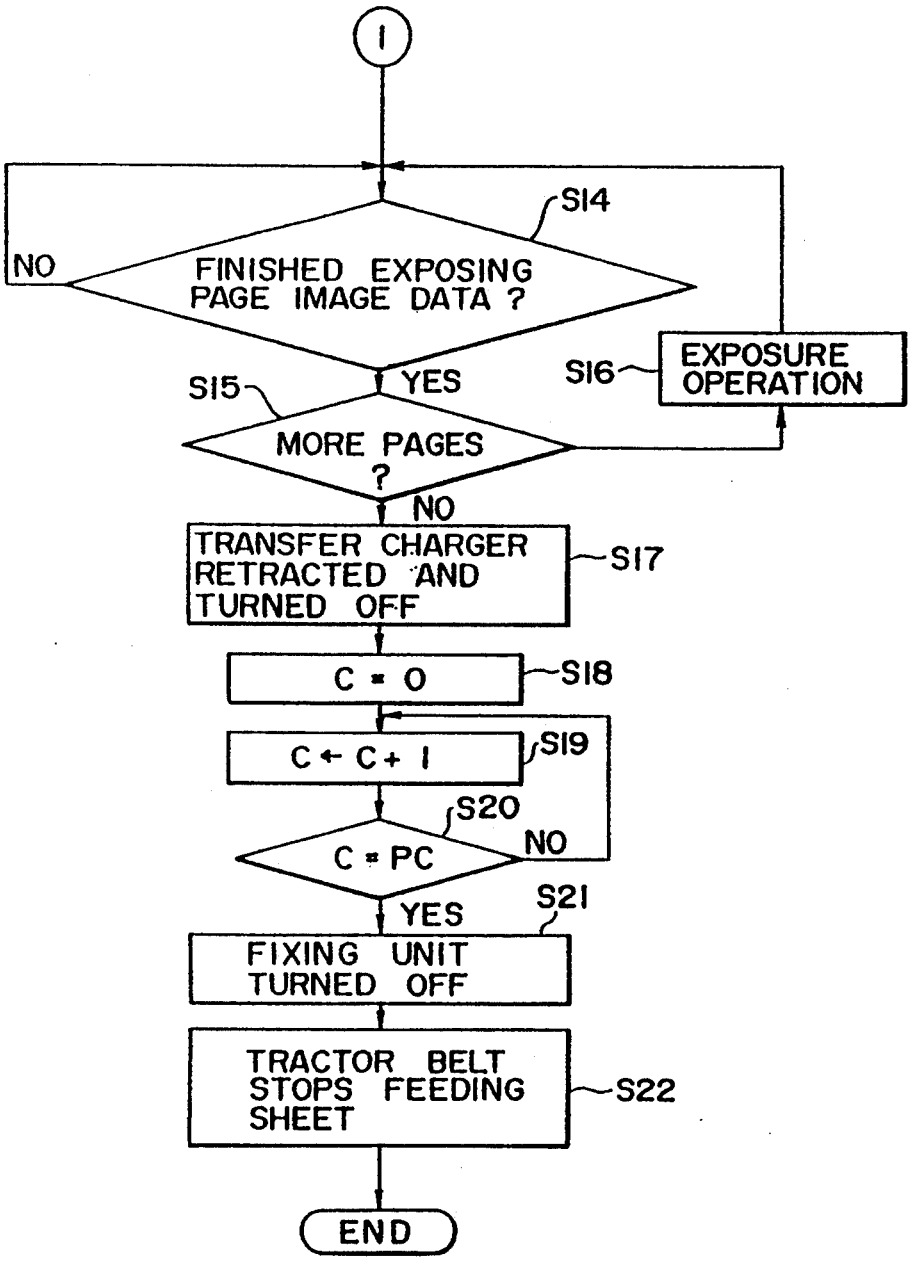

FIG. 9A and 9B show a flowchart illustrating the operation for preventing the overheating of the sheet P by the heat roller 50.

In steps S1 through S3, the feeding condition of the fan-fold sheet P is detected based on the detection signals outputted by the photosensors 38, 40 and 42. At this stage, the transfer charger of the transfer unit 26, and the heat roller 50 of the fixing unit 36 are retracted.

If sensor 38 is OFF, then it is determined that the fan-fold sheet P is not loaded. Then, in step S28, the display unit 128 displays "NO SHEET" and indicates that the loading of a sheet is required.

Figure 10:
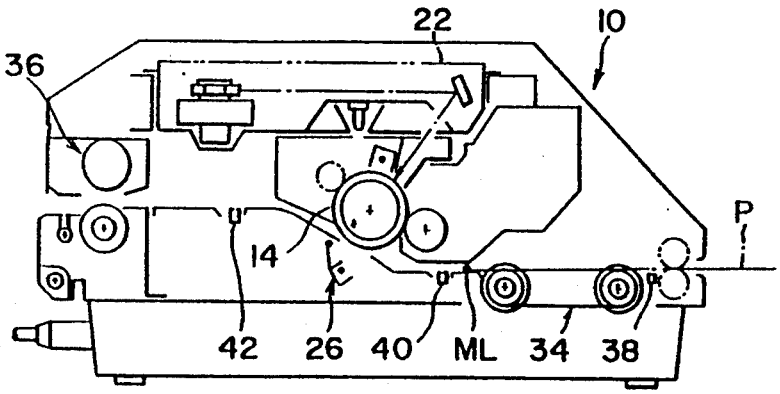
FIG. 10 is a schematic side view of the electrophotographic printer showing the condition where the continuous sheet has been introduced.

If the sensor 38 is ON, and the sensor 40 is OFF, then the leading edge ML of the fan-fold sheet P is located at a position between sensors 38 and 40, as shown in FIG. 10. In this case, the control unit 120 controls the tractor unit 34 to feed the fan-fold sheet P forward (step S23) until the leading end ML reaches sensor 40 and turns it on. Then the controller drives the tractor belt to feed the paper further forward, while counting the number of pulses C outputted by the encoder. Since the distance from sensor 40 to the position A is known, the number of pulses, N, that will be detected when the sheet travels this distance is also known. Therefore the controller waits until N pulses have been counted, then stops the feeding of the sheet.

If the sensor 38 is 0N, the sensor 40 is ON, and the sensor 42 is OFF (NO in step S3), then it is judged that the initial setting of the fan-fold sheet P has been completed and the laser beam printer 10 is in the standby state.

Figure 11:
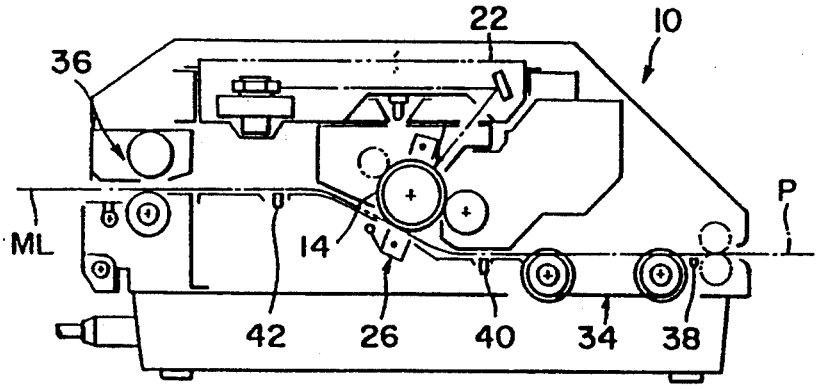
FIG. 11 is a schematic side view of the electrophotographic printer showing the condition where the printing operation is completed.
Figure 12:
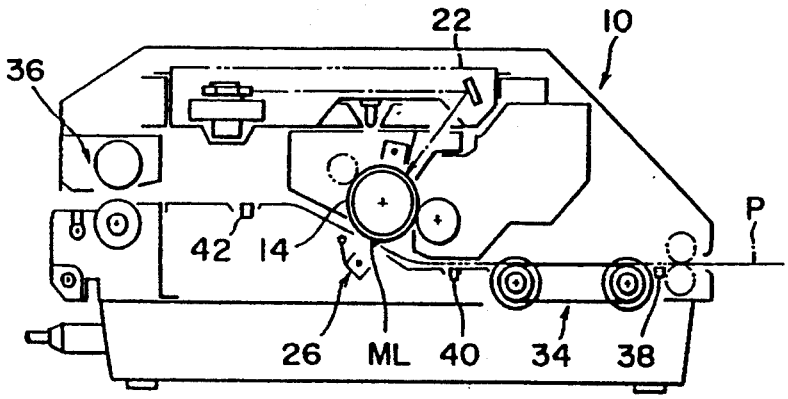
FIG. 12 is a schematic side view of the electrophotographic printer showing the condition where the leading edge of a sheet is located at its initial position.

If the sensor 38 is 0N, the sensor 40 is ON, and the sensor 42 is also ON (YES in step S3), then it is judged that the laser beam printer 10 has just finished the imaging (fixing) operation. Therefore the leading edge of the sheet ML to be printed is located as shown in FIG. 11. Therefore in order to print on the next sheet, the leading edge must be moved to the position A, as shown in FIG. 12. As explained in detail later on, the leading edge ML as shown in FIG. 11 is one page length downstream from the position A. Therefore the paper must be fed backwards this distance before printing can be started. Thus the controller activates the tractor belt to reversely feed the paper, in step S4. As the paper is being reversely fed, the controller is counting the pulses C outputted from the encoder 34*h*. Since the number of pulses equivalent to a page length, PC, is known, the controller stops the tractor belt after this number of pulses has been detected. Then the leading edge ML will be located at the position A.

The number PC is determined in accordance with the size of the fan-fold sheet P which is inputted through the operation panel 122, and stored in the memory unit 124. In the embodiment, one pulse is outputted as the sheet P is fed by $\frac{1}{2}$ inch. If the page length of a sheet P is 11 inches, then PC is 22, if the page length is 12, then PC is 24, and if the page length is 13, then PC is 26. Since the number PC is determined in accordance with the page length of the fan-fold sheet P, various sheets having various page lengths can be used in the same laser beam printer.

After the leading edge ML of the fan-fold sheet P has been fed to the position A, the rotation of the photoconductive drum 14 and the scanning operation of the laser scanning unit 22 is initiated (steps S9 and S10). As the rotation of the photoconductive drum 14 starts, the operations of the toner cleaning unit 16, the discharging unit 18, the charging unit 20, and the developing unit 24 are also initiated (not shown in the flowchart).

As the photoconductive drum 14 rotates, and the portion of the photoconductive drum 14 exposed to the laser beam reaches the transfer unit 26 (position A), the tractor 34 starts feeding the fan-fold sheet P (S11). At this stage, the transfer charger is moved to an operable position, and then turned ON to perform the transferring operation. Synchronously with the start of the transferring operation, the fixing operation is started (in step S12). This synchronous start of the fixing operation with respect to the transferring operation is one of the characteristic features of the present invention. Thus, a toner image on the photoconductive drum 14 is transferred onto the fan-fold sheet P, and at the same time the fixing operation is applied to the portion bearing no toner image (if the previously printed page was removed) or a fixed image (if the previously printed page is not removed).

Figure 13:
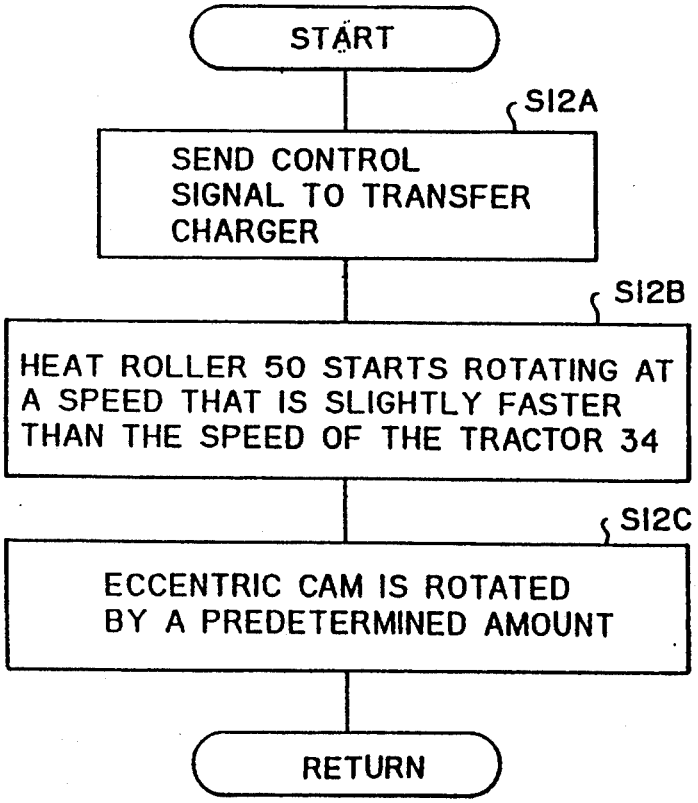
FIG. 13 is a flowchart detailing the fixing operation.

FIG. 13 is a flowchart illustrating the fixing operation. In step S12A, the control unit 120 transmits a drive signal to the transfer unit 26. The heat roller 50 starts rotating synchronously with the transmission of the drive signal (S12B). The surface speed of the heat roller 50 is slightly faster than the feeding speed of the tractor unit 34. This will ensure that the sheet is fed under a slight tension and thus prevent buckling. When the rotation of the heat roller 50 is started, the driving force of the main motor (not shown) is transmitted to the eccentric cam 90 to rotate the same (S12C) by a predetermined amount. In accordance with the rotation of the eccentric cam 90, the heat roller 50 is biased towards the press roller 52.

As described above, in the laser beam printer 10, according to the present invention, the rotating heat roller 50 is moved from the retracting position to the operable position where the fan-fold sheet P is nipped between the heat roller 50 and the press roller 52. Therefore, the portion of the sheet bearing the unfixed toner image is not located at the fixing unit when the rotating heat roller 50 is moved to the operating position.

Since the heat roller 50 contacts the portion of the sheet bearing no toner image or a fixed toner image, when the heat roller is moved to the operating position, the image is not smudged by the heat roller 50, and the quality of the image is maintained. Further, since the rotating heat roller 50 contacts the fan-fold sheet P while the fan-fold sheet P is being fed, the length of time that the heat roller 50 contacts one portion of the fan-fold sheet P is short. Therefore the overheating of the fan-fold sheet P by the heat roller 50 is prevented.

After one page of image data has been exposed on the photoconductive drum 14 (S14), it is determined whether a subsequent page is to be printed in step S15. If there is another page, a further exposure operation is performed in step S16.

If all of the pages are printed, the transfer unit 26 is turned OFF, and the transfer charger is retracted (step S17). The fan-fold sheet P is fed by an amount corresponding to one page length (steps S18 and S19). Then the fixing unit 36 is turned OFF, the heat roller 50 is retracted (step S21), the tractor 34 is stopped and the feeding of the fan-fold sheet P is stopped (S22). FIG. 11 shows the situation after the step S22 is executed.

After the fixing operation has been completed for the last page and the sheet P has been fed forward as described above, the printed pages can be detached from the continuous form.

After the printed part of the fan-fold sheet P is detached at the perforation line as mentioned above, the leading edge of the following page becomes a new ML. When the printing operation is restarted, the fan-fold sheet P is reversely fed by an amount equal to one page length thus moving the leading edge ML to the position A, and enabling the normal printing operation to be performed. If the printed pages are not detached from the continuous form when the printing operation is restarted, the printed page is retracted into the printer as the fan-fold sheet P is reversely fed. In this case, as mentioned above, when the heat roller 50 is moved to the operating position, it contacts the page bearing a fixed image, and therefore no degradation of the image occurs.

When the subsequent printing session is started the continuous form is reversely fed by a distance equal to one page length. Then printing is started on the sheet that follows the sheet P. No blank page is skipped when the subsequent printing operation is done.

Further, when the printing operation is begun, the heat roller is lowered into the operating position to contact the press roller, while the continuous form is being fed. Thus, in the case that the sheet has been detached from the continuous form, the heat roller contacts the press roller, and then a few seconds later the leading edge of the continuous form is nipped between the two rollers. Since the sheet is moving the heat transferred from the heat roller is enough to fix the toner image, but not enough to discolor or scorch the paper. In the case that the sheet P is not detached from the continuous form, the heat roller will be brought into contact with the paper and the press roller, but the paper will already have a toner image fixed to it and will be moving forward since the feeding operation is in progress. Thus, the heat transferred from the heat roller to the paper will not be high enough to discolor or scorch the paper, nor will it affect the toner image since this has already been fused.

The distance between the position A and the position B can be any length regardless of the page length of the fan-fold sheet P.

The present invention can be embodied in various other specific forms without departing from the characteristics thereof.

Figure 14A:
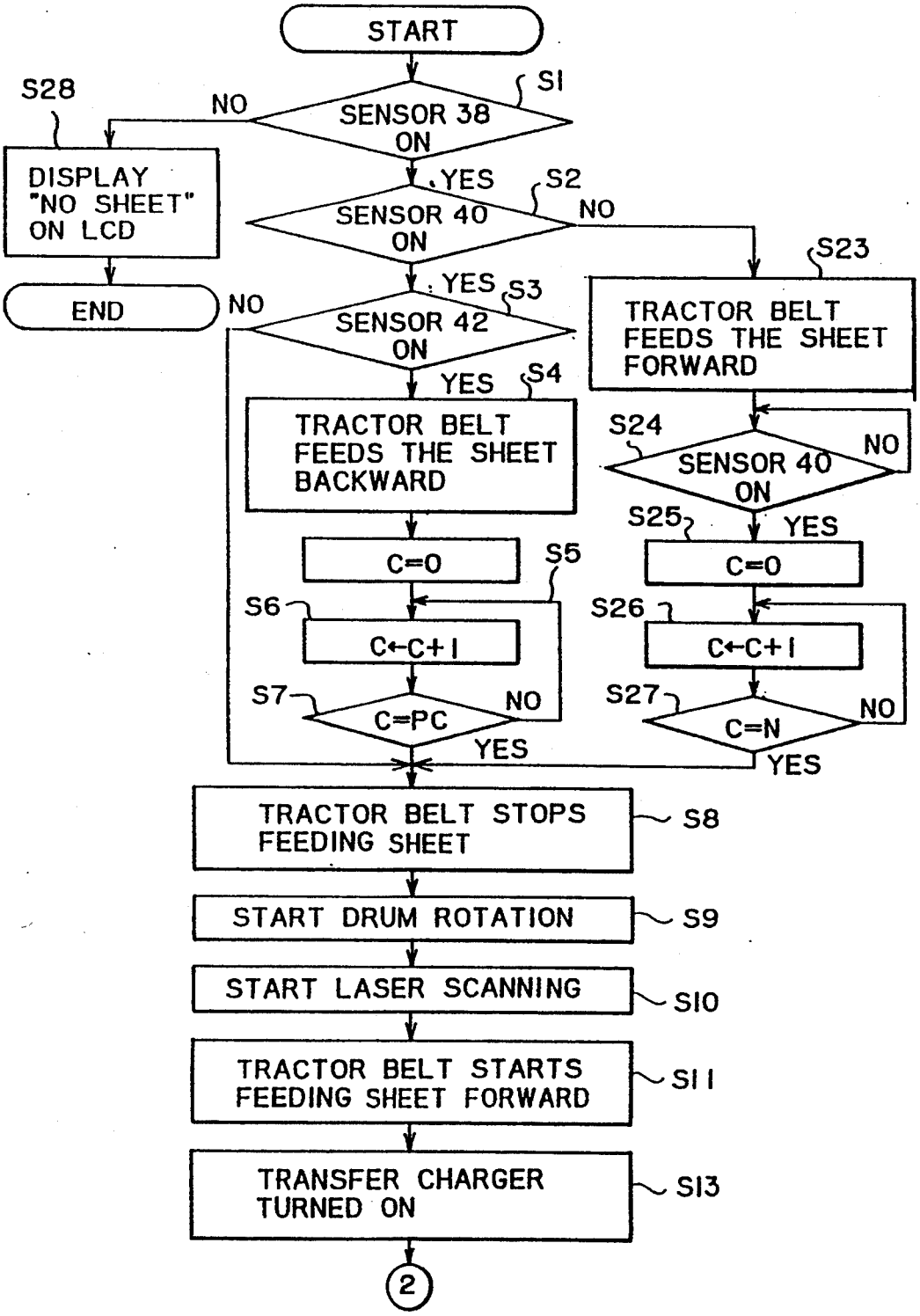
FIGS. 14A and 14B are flowcharts illustrating the imaging operation of a modified embodiment.
Figure 14B:
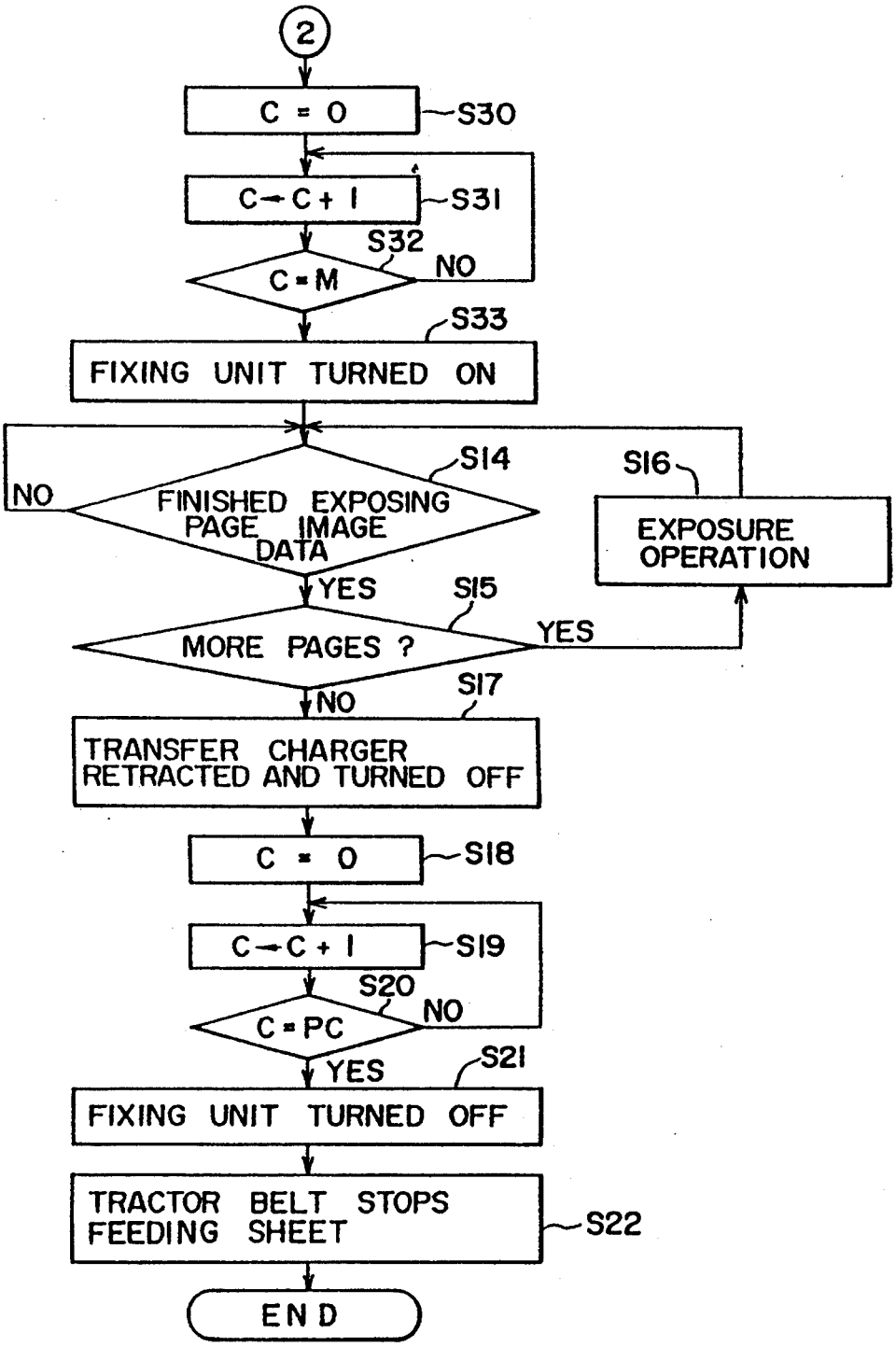

FIGS. 14A and 14B show a flowchart illustrating a modified control routine of the laser beam printer according to the present invention.

In the imaging operation illustrated in FIGS. 14A and 14B, a portion of the fan-fold sheet P bearing an unfixed toner image can be located at the position *B when the heat roller 50 is moved from the retracted position to the operating position. In this modification, in order to prevent smudging of the unfixed image when the heat roller 50 contacts thereto, the surface speed 50 of the rotating heat roller 50 and the feeding speed of the tractor unit 34 are set to the same value. In the flowchart, the steps similar to those in FIGS. 9A and 9B are denoted by the same step numbers, and explanation of these steps is omitted.

In step S11, the tractor belts 34*a* are driven to feed the fan-fold sheet P in the forward direction. Synchronously with the start of the sheet feed, the transfer unit 26 is turned on in step S13. In step S13, the fixing unit 36 is not turned on, and is thus different from step S12 in the embodiment described before.

After the transfer unit 26 is turned on, the number of pulses outputted by the encoder 34*h* is counted (in steps S30 and S31). When the number of the pulses is equal to M (in step S32), the fixing unit 36 is actuated (step S33). The number M corresponds to the number of pulses to be detected when the leading edge ML of the fan-fold sheet P is fed from the position A to the position *B. Accordingly, if there is an unfixed toner image at the leading end of the fan-fold sheet P, the rotating heat roller 50 will contact this image, and start the fixing operation.

Figure 15:
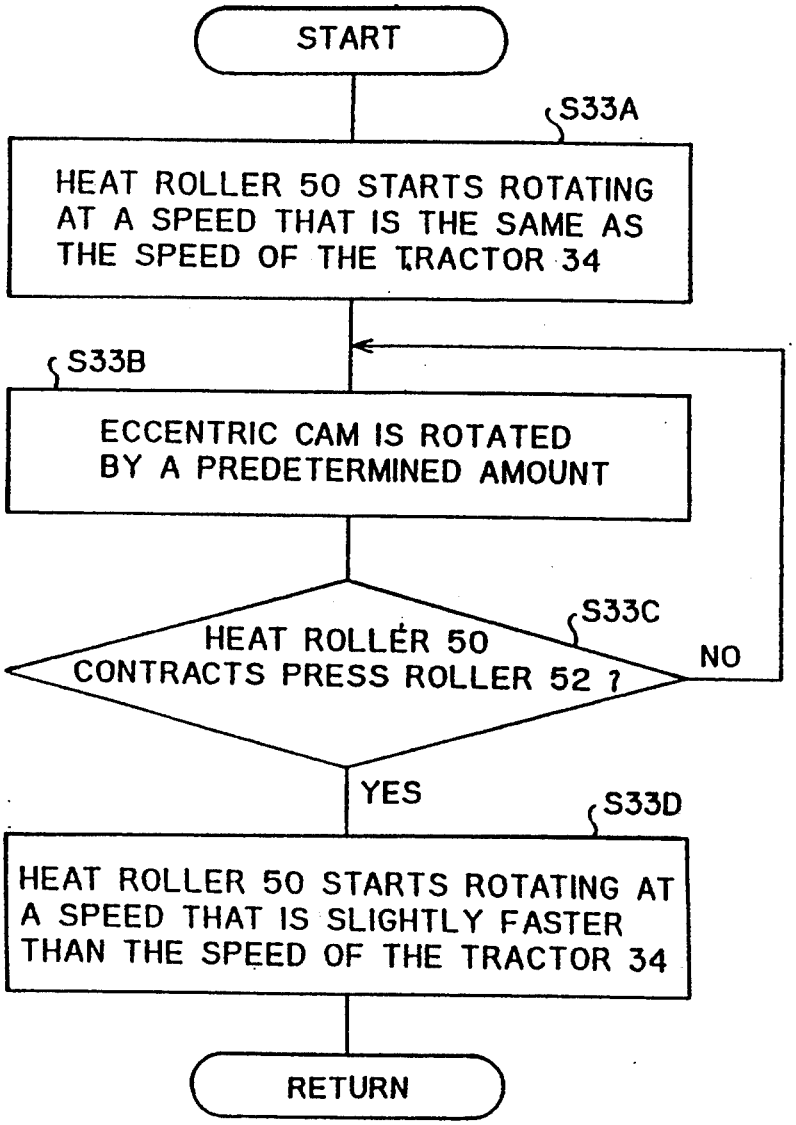
FIG. 15 is a flowchart detailing a subroutine of the fixing operation of the modified embodiment.

FIG. 15 is a flowchart illustrating the fixing operation mentioned above. In step S33A, the heat roller 50 is actuated to rotate, the surface speed of the heat roller 50 is substantially the same as the feeding speed of the tractor belt 34. When the heat roller 50 starts rotating, the main motor (not shown) is driven to rotate the eccentric cam 90 by a predetermined amount, and the heat roller 50 is moved toward the press roller 52 (in step S33A). When the heat roller 50 is located at the operating position, i.e., when the heat roller 50 is biased towards the press roller with the fan-fold sheet P nipped therebetween (in step S33C), the rotational speed is substantially the same as the feeding speed of the fan-fold sheet. Thus, the toner image is fixed without smudging. After the heat roller comes into contact with the sheet and the press roller, the rotational speed of the heat roller is increased so that it is slightly faster than the feeding speed of the tractor belt 34. Thus, the fan-fold sheet P is fed under tension.

As described above, the heat roller is not brought into contact with the sheet until the leading edge of the sheet is at the position B. Further, the sheet is being fed, and thus, the heat transferred from the heat roller to the sheet is enough to fix the toner image but not enough to discolor or scorch the sheet. Thus overheating of the sheet is prevented.

The present disclosure relates to subject matter contained in Japanese Utility Model Application No. HEI 4-93810, filed on Dec. 29, 1992, which is expressly incorporated herein by reference in its entirety.

What is claimed is:

1. An electrophotographic imaging apparatus for executing an imaging operation to form an image on a continuous recording sheet, said electrophotographic imaging apparatus comprising:

transferring means for transferring a toner image onto said continuous recording sheet;

fixing means for fixing an unfixed toner image transferred by said transferring means, said fixing means including a pair of rollers, at least one roller of said pair of rollers being movable with respect to another roller of said pair of rollers so as to be located at an operating position wherein said continuous recording sheet is nipped between said pair of rollers, or at a retracted position wherein said pair of rollers are apart from each other, said at least one roller being a heat roller;

feeding means for forwardly feeding said continuous recording sheet when said imaging operation is executed;

moving means for moving said at least one roller located at said retracted position to said operating position after said feeding means starts feeding said continuous recording sheet, and means for rotating said heat roller while said heat roller is heated and before said heat roller reaches said operating position, and wherein after said heat roller is moved to said operating position, a fixing of said image on said continuous recording sheet is carried out.

2. The electrophotographic imaging apparatus according to claim 1, wherein said feeding means reversely feeds said continuous recording sheet before forwardly feeding said continuous recording sheet so that a portion of said continuous sheet having the unfixed toner image is not nipped between said pair of rollers when said at least one roller is moved to said operating position.

3. The electrophotographic imaging apparatus according to claim 1, wherein a speed of said at least one roller is slightly faster than a feeding speed of said feeding means.

4. The electrophotographic imaging apparatus according to claim 1, wherein said moving means moves said at least one roller to said operating position when the unfixed toner image reaches said fixing means.

5. The electrophotographic imaging apparatus according to claim 1, wherein said moving means moves said at least one roller to said operating position when said transferring means starts transferring the toner image.

6. The electrophotographic imaging apparatus according to claim 1, wherein said pair of rollers comprise:

said heat roller; and a press roller, wherein said heat roller and said press roller are biased towards each other when the unfixed image is being fixed.

7. The electrophotographic imaging apparatus according to claim 6, wherein said feeding means feeds said continuous recording sheet so that all transferred images pass through said fixing means before said feeding means stops feeding.

8. The electrophotographic imaging apparatus according to claim 6, wherein said feeding means reversely feeds said continuous recording sheet so that a portion of said continuous recording sheet, having been located downstream of said fixing means and carrying no images, is located upstream of said transferring means when said imaging operation is executed.

9. The electrophotographic imaging apparatus according to claim 1, which executes said imaging operation on a page basis.

10. The electrophotographic imaging apparatus according to claim 1, wherein said heat roller is a roller heated to a predetermined temperature.

11. An electrophotographic imaging apparatus for executing an imaging operation to form an image on a continuous recording sheet, said electrophotographic imaging apparatus comprising:

an image transfer device;

a fixing device comprising a pair of rollers, at least one roller of said pair of rollers being movable relative to an other of said pair of rollers, wherein said at least one roller comprises a heating member heating said at least one roller;

said at least one roller being movable between an operating position wherein the continuous recording sheet is nipped between said pair of rollers, and a retracted position wherein said pair of rollers are positioned apart from each other;

a mechanism feeding the continuous recording sheet when the imaging operation is executed;

a moving device, said moving device moving said at least one roller between said retracted position and said operating position after said feeding mechanism begins feeding the continuous recording sheet; and a rotating mechanism, rotating said at least one roller while said roller is heated and before said moving device moves said at least one roller from said retracted position to said operating position, and wherein after said at least one roller is moved to said operating position, a fixing of said image on said continuous recording sheet is carried out.

* * * * *